US009805887B2

(12) United States Patent
Ferree

(10) Patent No.: US 9,805,887 B2
(45) Date of Patent: Oct. 31, 2017

(54) SLOT MOTOR CONFIGURATION FOR HIGH AMPERAGE MULTI-FINGER CIRCUIT BREAKER

(71) Applicant: Siemens Aktiengesellschaft, München (DE)

(72) Inventor: James Edward Ferree, Lawrenceville, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/071,622

(22) Filed: Mar. 16, 2016

(65) Prior Publication Data

US 2017/0271112 A1 Sep. 21, 2017

(51) Int. Cl.
*H01H 33/10* (2006.01)

(52) U.S. Cl.
CPC ..... *H01H 33/10* (2013.01); *H01H 2205/002* (2013.01); *H01H 2235/01* (2013.01)

(58) Field of Classification Search
CPC ..... H01H 2201/00; H01H 2300/032; H01H 47/002; H01H 50/021; H01H 50/08; H01H 50/54; H01H 71/04; H01H 9/168
See application file for complete search history.

(56) References Cited

U.S. PATENT DOCUMENTS 4,743,720 A * 5/1988 Takeuchi ..... H01H 9/302 218/24
4,963,849 A * 10/1990 Kowalczyk ..... H01H 9/342 218/35
5,847,629 A * 12/1998 Helms ..... H01H 1/226 218/22
6,229,418 B1 * 5/2001 Mueller ..... H01H 9/287 335/172
6,977,568 B1 12/2005 Rakus et al.
2005/0264388 A1 * 12/2005 Mueller ..... H01H 71/0257 335/202
2008/0079519 A1 * 4/2008 Shea ..... H01H 77/108 335/201
2014/0253264 A1 * 9/2014 Eberts ..... H01H 9/30 335/16
2015/0028973 A1 1/2015 Cardwell et al.
2015/0041436 A1 * 2/2015 Ferree ..... H01H 77/102 218/32

* cited by examiner

*Primary Examiner* — Truc Nguyen

(57) ABSTRACT

A multi-finger circuit breaker includes a moving contact assembly having a carrier body, a first plurality of fixed breaking contacts, a first plurality of movable contacts, a plurality of first fingers, at least one second finger longer in length to a length of a first finger of the plurality of first fingers, a plurality of splitter plates disposed adjacent to the plurality of first fingers and the at least one second finger and a slot motor disposed adjacent to the plurality of first fingers and the at least one second finger. The slot motor is configured to provide a first magnetic field force to amplify a second magnetic field force being applied on the second finger to influence an arc between the first plurality of fixed breaking contacts and the first plurality of movable contacts during a short circuit such that to move the arc away from between the first plurality of fixed breaking contacts and the first plurality of movable contacts and dissipate energy of the arc.

19 Claims, 8 Drawing Sheets

SLOT MOTOR CONFIGURATION FOR HIGH AMPERAGE MULTI-FINGER CIRCUIT BREAKER

BACKGROUND

1. Field

Aspects of the present invention generally relate to circuit breakers and more specifically relate to configuring a slot motor to generate a sufficient magnetic field force to move a short circuit arc away from between the breaking contacts for extinguishing it quickly to prevent excessive heat energy from accumulating in multi-finger circuit breakers.

2. Description of the Related Art

Any molded case circuit breaker (MCCB) or air circuit breaker (ACB) must be able to interrupt short circuits at the various circuit levels for which it is rated. At the short circuit levels of MCCBs and ACBs, a short circuit arc will continue to burn between the contacts unless some means is provided to move the arc away from between the contacts for dissipating its energy. Typically magnetic forces and gas flow arising from the expanding gases are exploited to move the arc, causing it to lengthen and also move into a set of arc splitter plates. Lengthening increases the resistance of the arc. The splitter plates cool the arc which increases resistance. Resistance in the arc generates an arc voltage that opposes current flow. The splitter plates create anode/cathode voltage drops which further add to the arc voltage. A quick increase of arc voltage is critical for extinguishing the arc quickly and preventing excessive heat energy from accumulating. Not only can excessive energy lead to failure to interrupt, but also limiting the let-through current is in general a desirable performance characteristic of circuit breakers.

A particular problem arises in larger circuit breakers with continuous current ratings of about 600 A and greater. These breakers require large copper cross-sections to carry the normal rated current without overheating. In the contact system it is common to use multiple parallel moving fingers. This is done because there are multiple contact points at the breaking contacts, this reduces the heating caused by contact interface current constrictions. However, much space in the width direction of the breaker is required to accommodate the multiple contact fingers and large copper cross-sections. This takes away from the options available to the designer for increasing arc force during short circuit interruption.

For example, in smaller circuit breakers rated approximately 400 A or less, only 1 movable contact finger is required in each pole of the breaker. This single finger is more narrow than the other parts in the pole of the breaker. Therefore it is possible to put additional parts on each side of the movable contact. Some of the different options available to the designer are, for example, (1) extending legs from the steel splitter plates to the sides of the contacts which mildly increases magnetic force, (2) adding a magnetic steel slot motor which strongly increases magnetic force, (3) adding outgassing plastic which increases gas flow, or (4) a combination of outgassing plastic with either a slot motor or extended splitter plates.

However, if there are multiple fingers side-by-side, there is not the room for these solutions that work in smaller breakers. Adding additional width to the breaker is usually undesirable because it increases overall size. But furthermore, increasing width has only limited benefit for improving arc force. The effectiveness of a slot motor is greatly reduced when the width of its opening is increased. Slot motors and likewise extended splitter plates lose most of their benefit of increasing magnetic arc force when they enclose more than 3 same length movable fingers. Outgassing plastic is less effective, because the exposed surface area is a smaller proportion compared to the arcing volume.

Therefore the problem is how to generate a strong force to move the short circuit arc away from between the breaking contacts, in large MCCBs or ACBs rated approximately 800 A or greater with more than 3 contact fingers. The problem is most critical at circuit levels with the higher voltage ratings such as 600V or 690V, especially when the prospective short-circuit current is at a low to moderate level, such as 15 to 50 kA. This is because the higher voltage tends to increase the heating and duration of the arc, and the relatively low short circuit current means it is more difficult to generate strong magnetic forces. By contrast, when the available short circuit level is very high, such as 70 kA or greater, the magnetic forces arising from the overall shape of the current path are usually sufficient to drive the arc into the splitter plates without any additional assistance. However, when the current is lower than this, magnetic forces arising from the overall shape of the current path are relatively small, and it would be helpful to assist arc movement by using magnetic steel parts to amplify the field strength, or use outgassing parts to increase gas flow.

Several approaches are used in prior art. One option is to reduce ratings. Some devices either offer no short circuit rating at the higher voltages, or else they offer very low current ratings at higher voltages to keep arc energy below the level that would create so much heat that the arc cannot be extinguished.

A second option is to provide large arc runners to guide the arc into the splitter plate assembly. But this solution allows the arc to burn for a relatively long time because there is not much enhancement of the arc force. Therefore it is necessary to have larger and more massive splitter plates to absorb the high energy, and possibly bigger breaking distances to produce an arc voltage. Examples of the second option are the Schneider PK 1200 A breaker and Siemens 3WL air circuit breakers.

In the third option one or more of the fingers in the middle of the multi-finger assembly are extended to a greater length in the direction toward the splitter plates, and also legs are extended from the sides of the splitter plates in the direction of the contacts. The splitter plates are U-shaped with the legs of the U on either side of the extended middle fingers. When the arc is burning in the throat of the U-shape, this induces a magnetic field in the steel splitter plates. The field loops around the steel and crosses through the throat of the U and thus the magnetic field crosses the burning arc itself, thus producing a force to drive the arc deeper into the splitter plates. Thus there are long fingers in the middle of the assembly and shorter fingers on the left and right outsides of the assembly.

In a short circuit there are magnetic repulsive forces that tend to blow the contact fingers open. Generally, all the multiple contacts tend to separate at approximately the same time. If one contact would open first, this would immediately increase the current through the other contacts so that they will separate also. After initial contact separation, there is sometimes a mechanical means provided, so that all fingers rotate open together as one assembly through large angles of motion, although small relative movements are possible between the individual fingers. The freedom for small relative individual motion is needed to accommodate differences in contact erosion, so that all contacts can close and carry current effectively. There are various concepts available for the mechanical system to achieve this common large finger rotation and still allow small relative movement. However, this concept of short and long fingers with the splitter plate side extensions also has several operational disadvantages.

Therefore, there is a need for improvements in multi-finger circuit breakers for extinguishing the short circuit arc between the breaking contacts quickly and preventing excessive heat energy from accumulating.

SUMMARY

Briefly described, aspects of the present invention relate to using a slot motor in place of the splitter plate side extensions with a circuit breaker having short and long fingers to generate a strong force to move the short circuit arc away from between the breaking contacts for extinguishing the arc quickly and preventing excessive heat energy from accumulating. In particular, a magnetic steel slot motor greatly amplifies the magnetic forces on the long fingers. To a lesser degree, a plurality of magnetic steel splitter plates also contribute and assist in amplifying the magnetic field. One of ordinary skill in the art appreciates that such a slot motor can be configured to be installed in a multi-finger circuit breaker, for example, in a high amperage circuit breaker having both short and long fingers present.

In accordance with one illustrative embodiment of the present invention, a moving contact assembly for a multi-finger circuit breaker is provided. The multi-finger circuit breaker comprises a carrier body having a carrier pivot for pivotal movement between a closed position and an open position, a first plurality of fixed breaking contacts and a first plurality of movable contacts, and a plurality of first fingers each of which is coupled to a corresponding one of the first plurality of movable contacts and coupled to the carrier body. The plurality of first fingers is configured for pivotal movement between a withstand position and a blow open position via the carrier pivot of the carrier body. The multi-finger circuit breaker further comprises at least one second finger coupled to a movable contact of the first plurality of movable contacts and coupled to the carrier body. The second finger is longer in length to a length of a first finger of the plurality of first fingers. The multi-finger circuit breaker further comprises a plurality of splitter plates disposed adjacent to the plurality of first fingers and the at least one second finger. The plurality of splitter plates are configured to influence an arc between the first plurality of fixed breaking contacts and the first plurality of movable contacts during a short circuit such that to move the arc away from between the first plurality of fixed breaking contacts and the first plurality of movable contacts and dissipate energy of the arc. The multi-finger circuit breaker further comprises a slot motor disposed adjacent to the plurality of first fingers and the at least one second finger. The slot motor is configured to provide a first magnetic field force to amplify a second magnetic field force being applied on the at least one second finger and the plurality of splitter plates are configured to further amplify the second magnetic field force.

In accordance with another illustrative embodiment of the present invention, a pole of a multi-finger circuit breaker comprises a plurality of first fingers coupled to a carrier body and at least one second finger coupled to the carrier body. The plurality of first fingers is configured for pivotal movement between a withstand position and a blow open position via a carrier pivot of the carrier body. The second finger is longer in length to a length of a first finger of the plurality of first fingers. The multi-finger circuit breaker further comprises a slot motor disposed adjacent to the plurality of first fingers and the at least one second finger. The slot motor is configured to provide a first magnetic field force to amplify a second magnetic field force being applied on the at least one second finger.

In accordance with yet another illustrative embodiment of the present invention, a method of opening a plurality of movable contacts of a pole of a circuit breaker during a short circuit is provided. The method comprises providing a plurality of first fingers coupled to a carrier body, the plurality of first fingers configured for pivotal movement between a withstand position and a blow open position via a carrier pivot of the carrier body, providing at least one second finger coupled to the carrier body, the at least one second finger is longer in length to a length of a first finger of the plurality of first fingers, and generating a first magnetic field force using a slot motor disposed adjacent to the plurality of first fingers and the at least one second finger to amplify a second magnetic field force being applied on the at least one second finger.

DETAILED DESCRIPTION

To facilitate an understanding of embodiments, principles, and features of the present invention, they are explained hereinafter with reference to implementation in illustrative embodiments. In particular, they are described in the context of being a slot motor disposed adjacent a plurality of short fingers and at least one long finger to amplify a magnetic field force being applied on the long finger in a multi-finger circuit breaker. For example, such a magnetic field force pulls an arc that develops on all of a plurality of movable contacts from the plurality of short fingers to the long finger when opening the plurality of movable contacts of a pole of the multi-finger circuit breaker during a short circuit. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
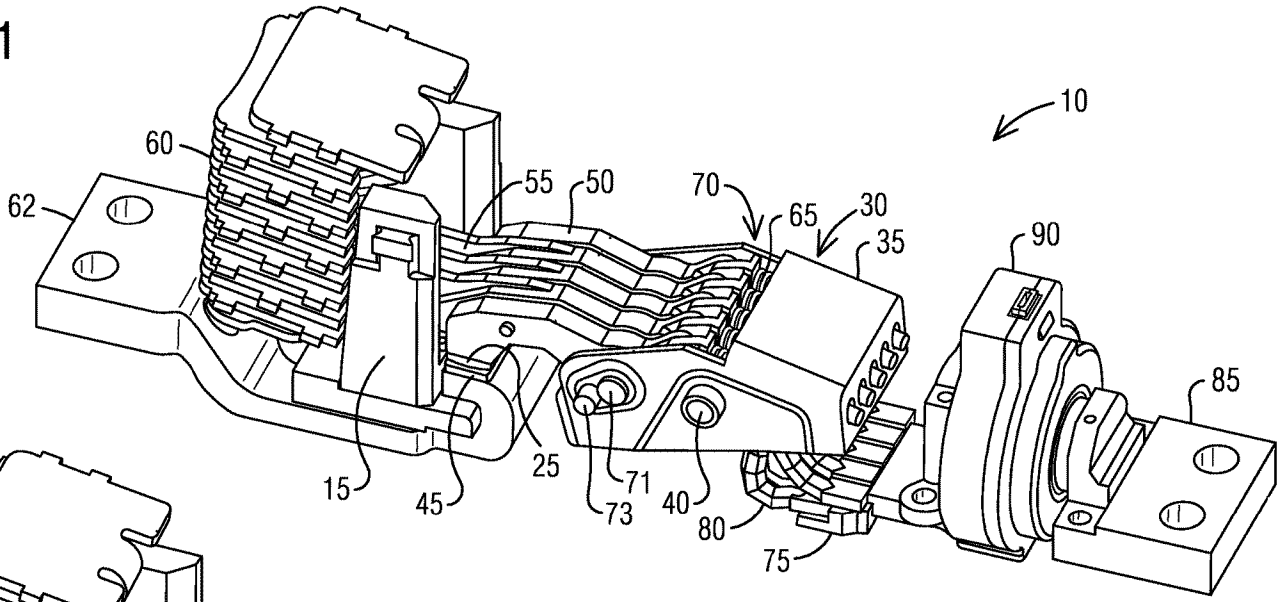
FIG. 1 illustrates an oblique view of a pole of a multi-finger circuit breaker with a slot motor in accordance with an exemplary embodiment of the present invention.

Consistent with one embodiment of the present invention, FIG. 1 represents an oblique view of a pole of a multi-finger circuit breaker 10 with an integrated slot motor 15 that is configured to provide a first magnetic field force to amplify a second magnetic field force being applied on at least one long finger 55 during a short circuit when opening a first plurality of movable contacts 25 of the pole of the multi-finger circuit breaker 10 in accordance with an exemplary embodiment of the present invention. For example, a slot motor used in lower amperage circuit breakers and breakers with usually only 1, 2, or 3 same length fingers may be now used in the multi-finger circuit breaker 10 with more fingers by using a combination of both short and long fingers with an insulating plastic over-molded on the slot motor, which have in the past been applied typically with U-shaped splitter plates.

The multi-finger circuit breaker 10 comprises a moving contact assembly 30 including a carrier body 35 having a carrier pivot 40 for pivotal movement between a closed position and an open position. The moving contact assembly 30 further comprises a first plurality of fixed breaking contacts 45 and the first plurality of movable contacts 25.

The moving contact assembly 30 further comprises a plurality of first fingers 50 each of which is coupled to a corresponding one of the first plurality of movable contacts 25 and coupled to the carrier body 35. The plurality of first fingers 50 configured for pivotal movement between a withstand position and a blow open position via the carrier pivot 40 of the carrier body 35. The moving contact assembly 30 further comprises the at least one long finger, i.e., the second finger 55 coupled to a movable contact of the first plurality of movable contacts 25 and coupled to the carrier body 35. The second finger 55 may be longer in length to a length of all fingers of the plurality of first fingers 50.

The multi-finger circuit breaker 10 comprises a plurality of splitter plates 60 disposed adjacent to the plurality of first fingers 50 and the second finger 55. The plurality of splitter plates 60 are configured to influence an arc between the first plurality of fixed breaking contacts 45 and the first plurality of movable contacts 25 during a short circuit such that it moves the arc away from between the first plurality of fixed breaking contacts 45 and the first plurality of movable contacts 25 and dissipates thermal energy of the arc.

The multi-finger circuit breaker 10 further comprises the slot motor 15 that is disposed adjacent to the plurality of first fingers 50 and the second finger 55. The slot motor 15 is configured to provide a first magnetic field force to amplify a second magnetic field force being applied on the second finger 55. The plurality of splitter plates 60 is configured to further amplify this second magnetic field force.

In one embodiment, the slot motor 15 comprises a magnetic steel structure with an insulating plastic over-molded on it. Outgassing material might be incorporated into an over-molded plastic layer of the slot motor 15, to further improve interrupting performance. The slot motor 15 may be a multi-piece structure in that two or more pieces are joined together to form a unified device or body. The slot motor 15 may be coupled to a line conductor 62 of copper.

Figure 2:
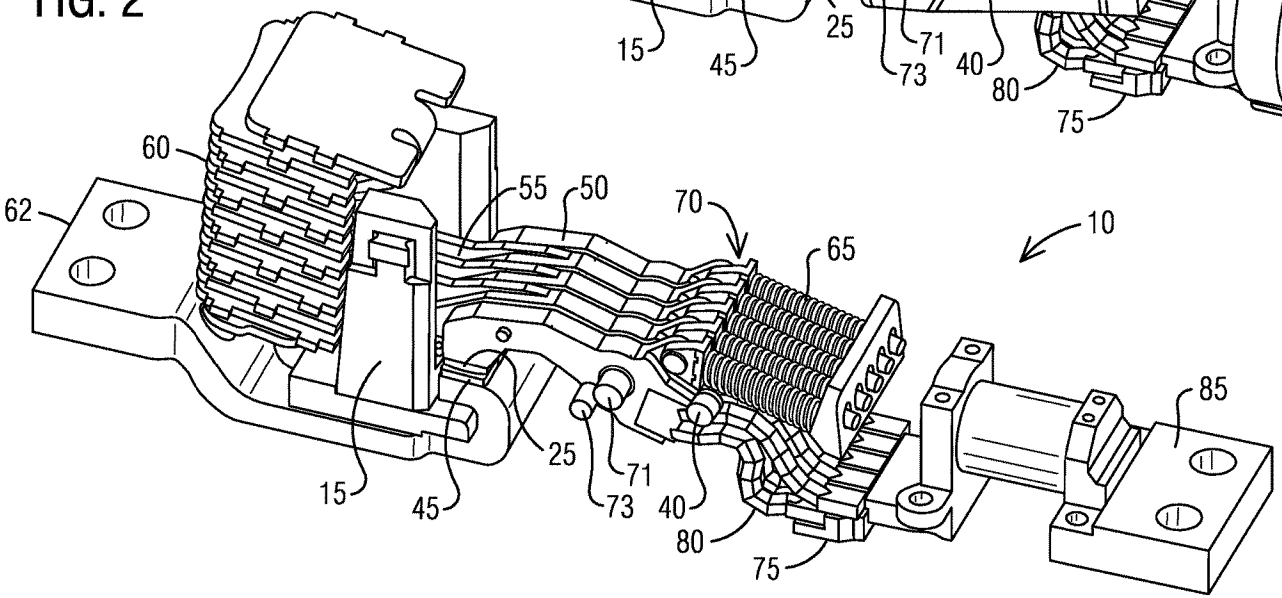
FIG. 2 illustrates an oblique view of a pole of a multi-finger circuit breaker with a slot motor and without a carrier in accordance with an exemplary embodiment of the present invention.

FIG. 1 shows a complete assembly of the slot motor 15 which comprises a steel core and an over-molded plastic layer. FIG. 2 and subsequent figures show only the steel core of the slot motor 15, for better understanding of the magnetic influence.

While the plurality of first fingers 50 and the second finger 55 are included as short and long fingers in the multi-finger circuit breaker 10, splitter plates with side extensions are replaced with the slot motor 15. Other details of the slot motor 15 are not set forth as slot motors are well-known in the art. However, the slot motor 15 integrated into the multi-finger circuit breaker 10 adjacent to the plurality of first fingers 50 and the second finger 55 has several advantages over the splitter plates with side extensions, as is described below.

The plurality of splitter plates 60 may comprise magnetic steel. Furthermore, the carrier body 35 may comprise non-magnetic stainless steel. The carrier body 35 may include a plurality of contact pressure springs 65 and a plurality of guide pins 70. The carrier body further comprises a finger pivot 71 and a drive link attachment pin 73. The carrier body 35 may be coupled to a braid terminal 75 of copper via a flexible braid 80 of copper. While braids are shown, alternatively conducting pivot joints may be incorporated. The braid terminal 75 may be coupled to a load terminal 85 of copper via a current transformer 90. In particular, the plurality of first fingers 50 and the second finger 55 are connected to the conductors on the load end of the multi-finger circuit breaker 10 via fine-stranded flexible copper braids.

FIG. 1 shows the components inside one pole of the multi-finger circuit breaker 10 being a Molded Case Circuit Breaker (MCCB). The multi-finger circuit breaker 10 comprises a housing and an operating mechanism which are not shown. During normal ON and OFF switching, the operating mechanism acts on the drive link attachment pin 73 to rotate the carrier body 35 and the plurality of first fingers 50 and the second finger 55 about the carrier pivot 40.

During a short circuit, contact opening is much more rapid, and the operating mechanism does not have time to respond, so the carrier body 35 may remain stationary for some time while it is waiting for the operating mechanism to trip. In a short circuit, there are strong magnetic repulsive forces that drive the plurality of first fingers 50 and the second finger 55 open, rotating about the finger pivot 71. The magnetic field forces are strong enough to overcome forces of the contact pressure springs 65 shown more clearly in FIG. 2. The magnetic field forces arise from the shape of the line conductor 62 which comprises a reverse current loop with respect to the movable plurality of first fingers 50 and the second finger 55. The magnetic field forces on the second finger 55, i.e., the long finger(s) are greatly amplified by the presence of the magnetic steel of the slot motor 15. To a lesser degree, the magnetic steel of the splitter plates 60 also contributes and assists in amplifying these magnetic field forces.

In operation, the magnetic field in the slot motor 15 is excited by a current flowing in the line conductor 62. A strong magnetic field crosses in the opening between the two sides of the slot motor 15.

In general, like most MCCBs and Air Circuit Breakers (ACBs), a strong magnetic field is desirable because it provides two benefits. First, the magnetic field acts on the current flowing in the plurality of first fingers 50 and the second finger 55 to generate a magnetic blow-apart force. This force opens the plurality of first fingers 50 and the second finger 55 rapidly to help in interrupting the short circuit. Second, the magnetic field acts on the electric arc, to move it toward and into the splitter plates 60. The increase in arc length, the sinking of heat by the splitter plates 60, and the anode and cathode voltage drops in the splitter plates 60 rapidly increase arc voltage and cause the current to cease and the arc to be extinguished.

There will be some level of additional magnetic field acting on both the plurality of first fingers 50 and the second finger 55, i.e., the short and long fingers, respectively. However, the magnetic field acting on the long fingers, and the arc which develops between the long finger contacts, will be much stronger than the short fingers.

The multi-finger circuit breaker 10 may be used to protect electrical apparatus. For example, a molded case circuit breaker (MCCB) offers solutions for power distribution applications. The multi-finger circuit breaker 10 may have rated current from 16 A to 1600 A. It may be a multi-pole circuit breaker such as a 3 Pole or a 4 Pole. The circuit breaker 10 may include a Thermal Magnetic and Microprocessor based electronic trip units (ETUs) and it may have communication capable ETUs. Typical applications include incoming and outgoing circuit breakers in power distribution applications or switching and protection devices for motors, transformers, generators, capacitors, busbars and cables. The multi-finger circuit breaker 10 may include Molded Case Switches or Motor Circuit Protectors. The multi-finger circuit breaker 10 may alternatively have rated current range from 630 A to 6300 A. The type of circuit breakers is suitable for applications up to 1150 VAC and as non-automatic switches up to 1000 VDC. The multi-finger circuit breaker 10 may have a switching capacity 200 kA/100 kA at a voltage up to 480 VAC, or a switching capacity up to 100 kA at a voltage up to 690 VAC. Available constructions to choose from may be 1-pole, 2 Pole, or 3-Pole.

For example, the multi-finger circuit breaker 10 is for use in individual enclosures, switchboards, panelboards, and load centers. The multi-finger circuit breaker 10 may include a Thermal Magnetic Trip Unit (TMTU). The Thermal Magnetic Trip Unit (TMTU) may provide complete overload and short circuit protection by use of a time delay thermal trip element and an instantaneous magnetic trip element. The multi-finger circuit breaker 10 may include a molded case switch having a factory-installed preset instantaneous function to allow the switch to trip at a value over 4000 A and protect itself against high fault conditions. Overload and fault current protection may be provided by separate overcurrent devices.

In the multi-finger circuit breaker 10 being a 1-POLE circuit breaker, with the mechanism latched and the contacts open, an operating handle will be in the OFF position. Moving the operating handle to the ON position closes the contacts and establishes a circuit through the multi-finger circuit breaker 10. Under overload or short circuit conditions sufficient to automatically trip or open the multi-finger circuit breaker 10, the operating handle moves to a position between ON and OFF. To relatch the multi-finger circuit breaker 10 after automatic operation, the operating handle can be moved to the extreme OFF position. The multi-finger circuit breaker 10 becomes ready for reclosing. An overcenter toggle mechanism may be trip free of the operating handle. The multi-finger circuit breaker 10, therefore, cannot be held closed by means of the operating handle should a tripping condition exist. After automatic operation, the operating handle assumes an intermediate position between ON and OFF, thus displaying a clear indication of tripping.

As used herein, the "circuit breaker" refers to a single or multi-pole circuit breaker, as described herein, which corresponds to an automatically operated electrical switch designed to protect an electrical circuit from damage caused by overload or short circuit. Its basic function is to detect a fault condition and interrupt current flow. The "multi-pole circuit breaker," in addition to the exemplary hardware description above, refers to a device that is configured to reset (either manually or automatically) to resume normal operation. The "multi-pole circuit breaker," may be used to protect an individual household appliance up to a large switchgear designed to protect high voltage circuits feeding an entire city, and operated by a controller. It should be appreciated that several other components may be included in the "multi-pole circuit breaker." The "multi-pole circuit breaker," may be capable of operating based on its features such as voltage class, construction type, interrupting type, and structural features.

The techniques described herein can be particularly useful for opening a plurality of movable contacts of a pole of a molded case circuit breaker (MCCB) or an air circuit breaker (ACB). While particular embodiments are described in terms of the slot motor 15, the techniques described herein are not limited to slot motors but can also use other suitable magnetic steel structures, such as a multi-piece structure in that two or more pieces are joined together to form a unified device or body.

Referring to FIG. 2, it illustrates an oblique view of a pole of the multi-finger circuit breaker 10 with the slot motor 15 and without a carrier in accordance with an exemplary embodiment of the present invention. The plurality of contact pressure springs 65 and the plurality of guide pins 70 are more clearly visible as the carrier is removed for clarity. The magnetic steel of the slot motor 15 is also visible as the over-molded plastic is removed for clarity.

Embodiments of the present invention are not limited to a type of spring system shown on FIG. 2 as it is merely an example. FIG. 2 shows flexible braids to connect the plurality of first fingers 50 and the second finger 55 to the fixed conductors. Embodiments of the present invention would work equally well with conducting pivot joints for the plurality of first fingers 50 and the second finger 55.

Figure 3:
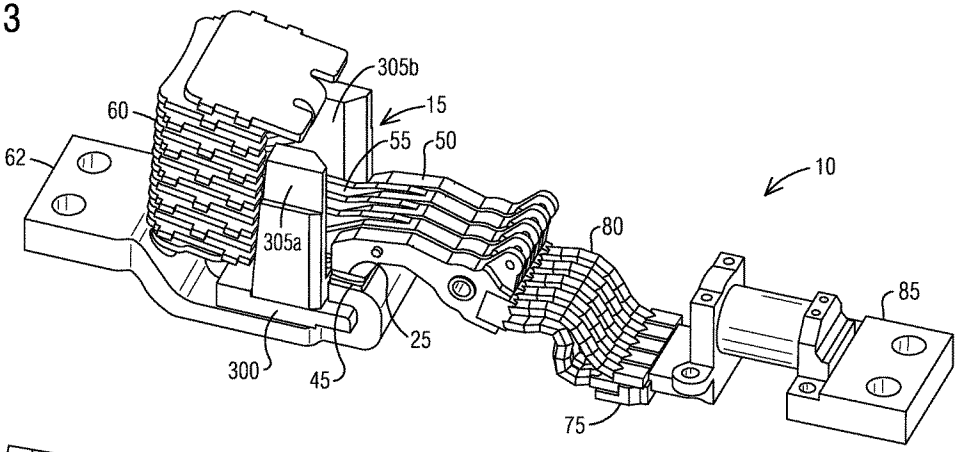
FIG. 3 illustrates an oblique view of only the current-carrying components and components with magnetic function of the multi-finger circuit breaker of FIG. 1 in accordance with an exemplary embodiment of the present invention.

Turning now to FIG. 3, it illustrates an oblique view of only the current-carrying components and components with magnetic function of the multi-finger circuit breaker 10 of FIG. 1 in accordance with an exemplary embodiment of the present invention. The slot motor 15 is shown in three pieces—a bottom 300 and two sides 305*a*, 305*b*. However, the slot motor 15 may be a one-piece construction slot motor as well. By using 3 pieces, advantages are gained regarding electrical insulation and modular assembly. However, for a monolithic slot motor the magnetic field is slightly enhanced compared to a modular configuration. Both a monolithic slot motor and a modular configuration enable the multi-finger circuit breaker 10 to interrupt short circuits effectively.

Figure 4:
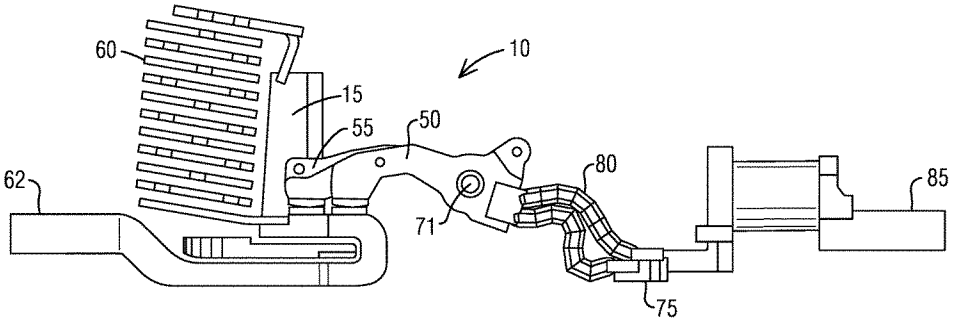
FIG. 4 illustrates a side view of a semi-transparent (the near side of the slot motor has been removed for clarity) slot motor of the multi-finger circuit breaker of FIG. 1 in accordance with an exemplary embodiment of the present invention.
Figure 5:
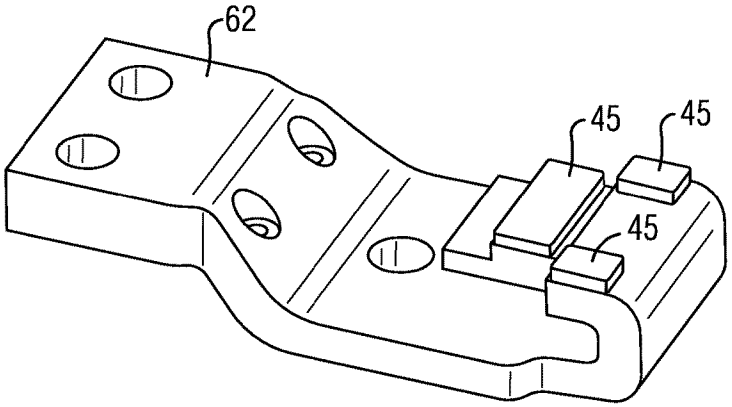
FIG. 5 illustrates an oblique view of a line conductor with fixed contacts of the multi-finger circuit breaker of FIG. 1 in accordance with an exemplary embodiment of the present invention.

FIGS. 3-5 clarify the locations of the first plurality of movable contacts 25 and how the second finger 55, i.e., the long finger(s) extend between the sides 305*a*, 305*b* of the slot motor 15. In particular, FIG. 4 illustrates a side view of the slot motor 15 of the multi-finger circuit breaker 10 of FIG. 1 in which the slot motor 15 is shown as semi-transparent (left side has been removed for clarity) in accordance with an exemplary embodiment of the present invention. As seen in FIG. 4, the second finger 55, i.e., the long finger(s) extends into the slot motor 15. In this way, a magnetic field acting on the second finger 55, i.e., the long finger(s), and the arc which develops between the long finger contacts, will be much stronger than the short fingers.

As shown in FIG. 5, it illustrates an oblique view of the line conductor 62 with the first plurality of fixed breaking contacts 45 of the multi-finger circuit breaker 10 of FIG. 1 in accordance with an exemplary embodiment of the present invention. In one embodiment, the first plurality of fixed breaking contacts 45 and the first plurality of movable contacts 25 may be made of silver or silver-containing electrical contact material.

Figure 6:
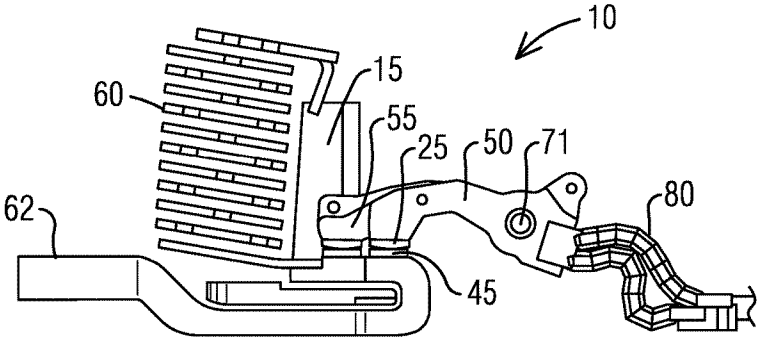
FIG. 6 illustrates a side view of contacts closed as part of progressive views depicting opening during a short circuit for the multi-finger circuit breaker of FIG. 1 in accordance with an exemplary embodiment of the present invention.

As seen in FIG. 6, it illustrates a side view of the first plurality of fixed breaking contacts 45 and the first plurality of movable contacts 25 closed as part of progressive views depicting opening during a short circuit for the multi-finger circuit breaker 10 of FIG. 1 in accordance with an exemplary embodiment of the present invention. More specifically, FIG. 6 shows the first plurality of movable contacts 25 closed prior to the short circuit. When the short circuit begins, high levels of a current in the current path cause magnetic repulsion forces, known as Lorentz forces, that act on the plurality of first fingers 50 and the second finger 55, tending to rotate the fingers clockwise about the finger pivot 71. There are also additional repulsive forces, often called blow-off forces, at each of the contact interfaces between the first plurality of fixed breaking contacts 45 and the first plurality of movable contacts 25 due to constriction of the current to microscopic points of electrical conduction, known in the industry as "A-spots". The blow-off forces act together with the Lorentz forces. When the current level is high enough that the combined blow-off and Lorentz forces exceed the opposing force from the plurality of contact pressure springs 65, then the plurality of first fingers 50 and the second finger 55 begin to rotate and the first plurality of fixed breaking contacts 45 and the first plurality of movable contacts 25 separate. The threshold current that causes contacts to separate is called a pop-up current level.

The plurality of first fingers 50 and the second finger 55 are all connected electrically with negligible voltage difference between them. The spring forces are tuned so that roughly similar pop-up current levels are required for each of them to begin to open. This means that the spring torque on the plurality of first fingers 50. i.e., the short fingers must be smaller than the second finger 55, i.e., the long finger(s). However, the tuning of the spring forces for the pop-up current level need not be precisely equal, rather, only roughly similar. If one finger tends to open sooner than the others, the current will quickly redistribute to the closed fingers. But this increases the Lorentz and blow-apart forces so these fingers will exceed the spring forces also. After the first finger begins to open, then the sudden increase in current in the other fingers due to redistribution of current will cause them to pop-up also. This means pop-up occurs on all fingers nearly at the same time. Therefore, the finger with the lowest pop-up level determines the pop-up level of the plurality of first fingers 50 and the second finger 55 of a multi-finger assembly.

Figure 7:
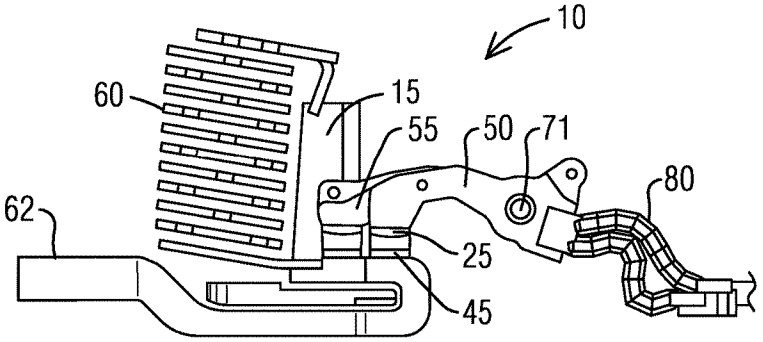
FIG. 7 illustrates a side view of contacts beginning to open as an arc develops on all finger contacts as part of progressive views depicting opening during a short circuit for the multi-finger circuit breaker of FIG. 1 in accordance with an exemplary embodiment of the present invention.

In FIG. 7, it illustrates a side view of the first plurality of movable contacts 25 beginning to open as an arc develops on all finger contacts as part of progressive views depicting opening during a short circuit for the multi-finger circuit breaker 10 of FIG. 1 in accordance with an exemplary embodiment of the present invention. As is depicted, FIG. 7 shows the plurality of first fingers 50 and the second finger 55 in the beginning of the blow-open process. In a worst case possibility, an arc may develop on all pairs of contacts 25, 45. However, the strong magnetic field created by the slot motor 15 pushes the arc toward the splitter plates 60. This creates a flow of gas towards the left in FIG. 7. Cooler, less conductive gas is drawn to the left, reducing the current on the plurality of first fingers 50, i.e., the short fingers. Because all fingers are at the same voltage, there is no tendency for the arc to remain on the short fingers. The arc moves onto the tips of the second finger 55, i.e., the long finger(s), between the slot motor 15 sides 305*a*, 305*b*, where the magnetic field is strong.

Figure 8:
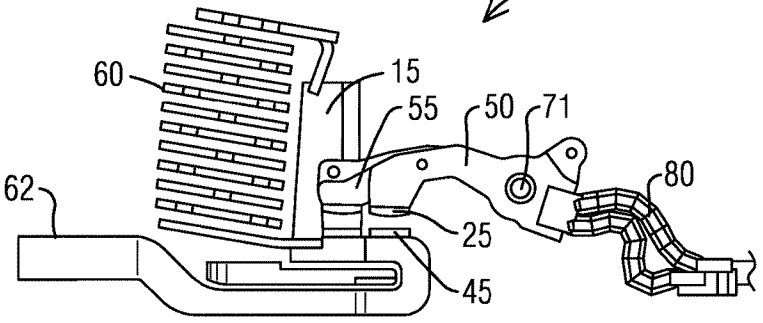
FIG. 8 illustrates a side view of contacts beginning to open further as magnetic forces and gas flow pull the arc from the short fingers to the long fingers as part of progressive views depicting opening during a short circuit for the multi-finger circuit breaker of FIG. 1 in accordance with an exemplary embodiment of the present invention.

With regard to FIG. 8, it illustrates a side view of the first plurality of movable contacts 25 beginning to open further as magnetic forces and gas flow pull the arc from the plurality of first fingers 50, i.e., the short fingers to the second finger 55, i.e., the long finger(s) as part of progressive views depicting opening during a short circuit for the multi-finger circuit breaker 10 of FIG. 1 in accordance with an exemplary embodiment of the present invention. The arc continues moving to the left and into the splitter plates 60 as shown in FIG. 8. The splitter plates 60 then sink heat from the gas, cooling it and reducing the conductivity, which increases arc voltage. The anode and cathode voltage drop from adjacent pairs of splitter plates 60 also significantly increases arc voltage. As arc voltage increases above the system voltage, current ceases to flow.

Figure 9:
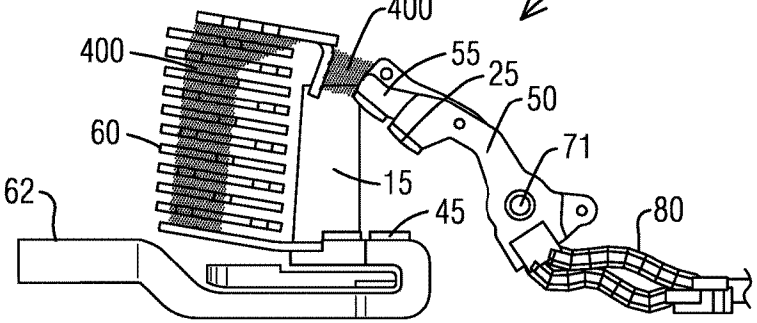
FIG. 9 illustrates a side view of contacts fully open as arc is driven into the splitter plates as part of progressive views depicting opening during a short circuit for the multi-finger circuit breaker of FIG. 1 in accordance with an exemplary embodiment of the present invention.

With respect to FIG. 9, it illustrates a side view of the first plurality of movable contacts 25 fully open as an arc 400 is driven into the splitter plates 60 as part of progressive views depicting opening during a short circuit for the multi-finger circuit breaker 10 of FIG. 1 in accordance with an exemplary embodiment of the present invention. As mentioned previously, all the plurality of first fingers 50, i.e., the short fingers and the second finger 55, i.e., the long finger(s) pop up nearly at the same time. However, after the plurality of first fingers 50, i.e., the short fingers and the second finger 55, i.e., the long finger(s) are open, the greater length of the long fingers and the fact that the current has moved to the longer fingers means the torque on the longer fingers is much greater than the short fingers. With such unequal torque, the short fingers might tend to reclose while the long fingers continue to move toward open. Therefore, a mechanical means is provided to assure that all fingers move together toward open. Torque from the long fingers is to be transferred to the short fingers, so that all fingers open together.

At the same time, a suitable mechanical system provides for individual springs on each contact and allows small relative movements between contacts, to allow for good contact pressure in spite of unequal contact erosion. Several mechanical systems are possible which would satisfy this need. One example uses an inner and outer carrier system. Another possibility (not shown) is to install a metal rod transversely in the middle finger, which passes through slots in the other fingers. However, a preferred solution is a finger interlock system.

Figure 10:
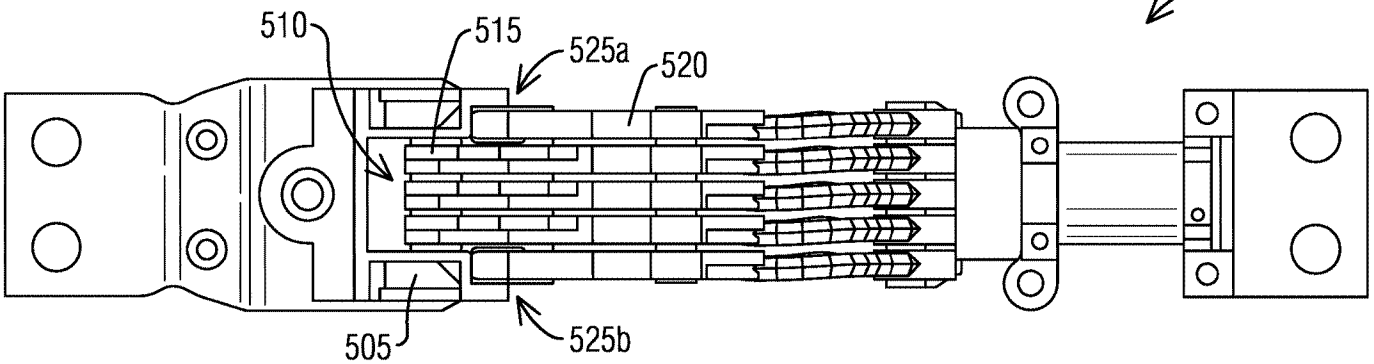
FIG. 10 illustrates a top view of a finger configuration with 3 long fingers and 2 short fingers for the multi-finger circuit breaker of FIG. 1 in accordance with an exemplary embodiment of the present invention.

Now referring to FIG. 10, it illustrates a top view of a finger configuration with 3 long fingers and 2 short fingers for a multi-finger circuit breaker 500 in accordance with an exemplary embodiment of the present invention. A slot motor 505 is configured to locate adjacent to a tip portion 510 of a plurality of long fingers 515. A plurality of short fingers 520 is disposed on two sides 525*a*, 525*b* of the plurality of long fingers 515. A plurality of splitter plates is not shown in FIG. 10.

Figure 11:
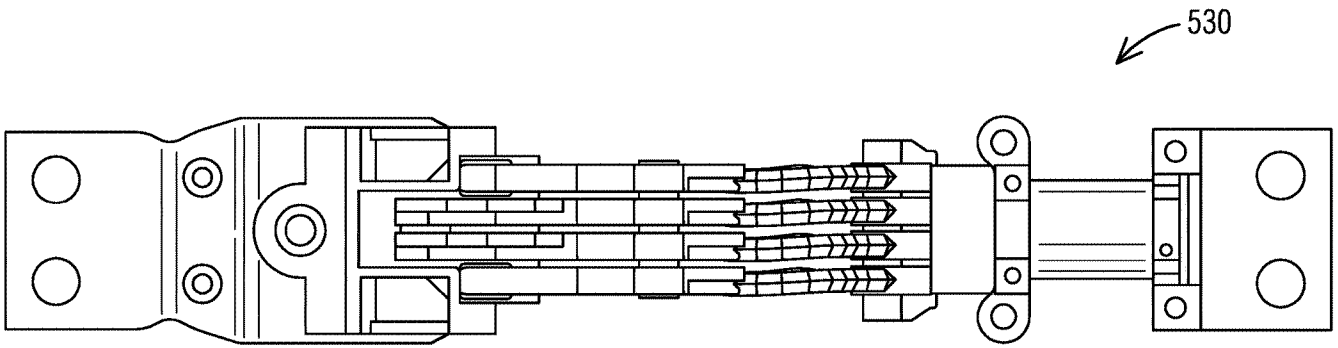
FIG. 11 illustrates a top view of another finger configuration with 2 long fingers and 2 short fingers for the multi-finger circuit breaker of FIG. 1 in accordance with an exemplary embodiment of the present invention.
Figure 12:
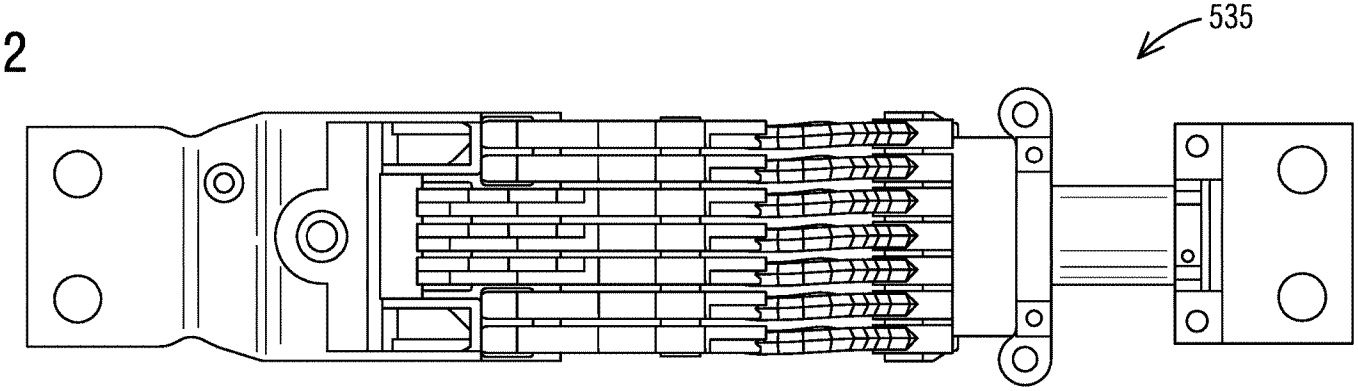
FIG. 12 illustrates a top view of yet another finger configuration with 2 long fingers and 4 short fingers for the multi-finger circuit breaker of FIG. 1 in accordance with an exemplary embodiment of the present invention.
Figure 13:
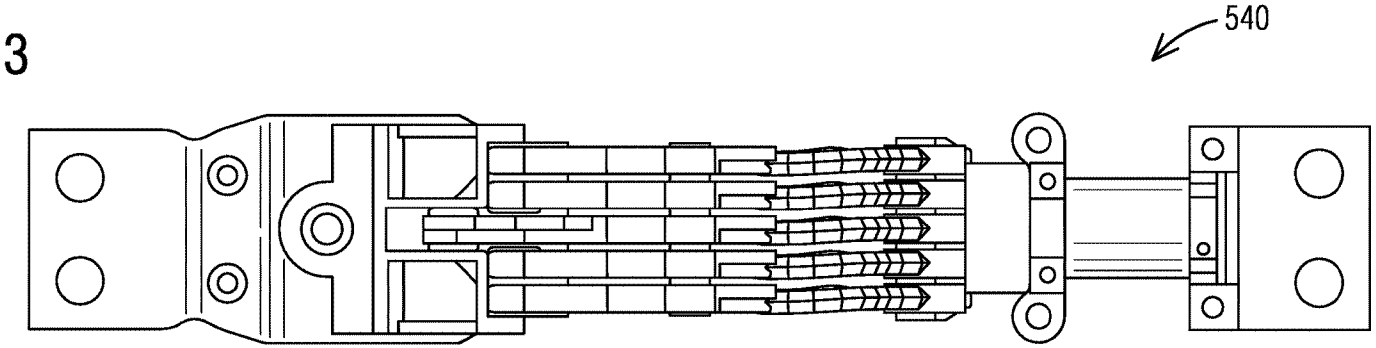
FIG. 13 illustrates a top view of a still another finger configuration with 1 long finger and 4 short fingers for the multi-finger circuit breaker of FIG. 1 in accordance with an exemplary embodiment of the present invention.

FIG. 11 illustrates a top view of another finger configuration with 2 long fingers and 2 short fingers for a multi-finger circuit breaker 530 in accordance with an exemplary embodiment of the present invention. FIG. 12 illustrates a top view of yet another finger configuration with 2 long fingers and 4 short fingers for a multi-finger circuit breaker 535 in accordance with an exemplary embodiment of the present invention. FIG. 13 illustrates a top view of a still another finger configuration with 1 long finger and 4 short fingers for a multi-finger circuit breaker 540 in accordance with an exemplary embodiment of the present invention.

Figure 14:
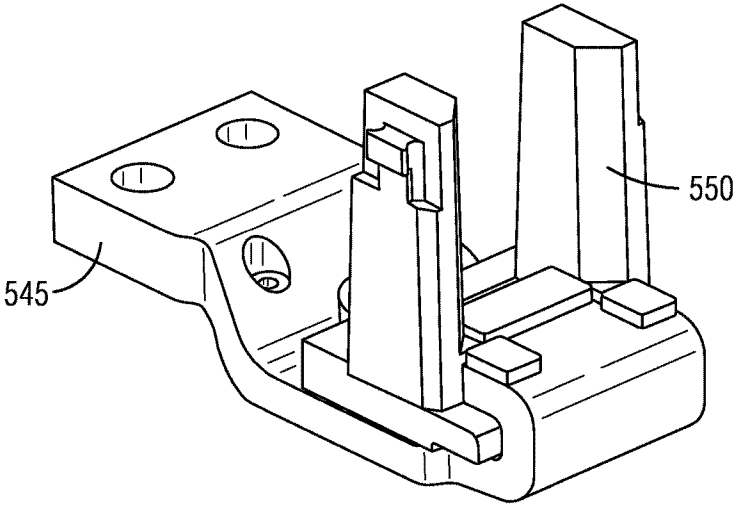
FIG. 14 illustrates an oblique view of a line conductor with a slot motor in accordance with an exemplary embodiment of the present invention.

FIG. 14 illustrates an oblique view of a line conductor 545 with a slot motor 550 in accordance with an exemplary embodiment of the present invention. The slot motor 550 may be a multi-piece structure in that two or more pieces are joined together to form a unified device or body.

Figure 15:
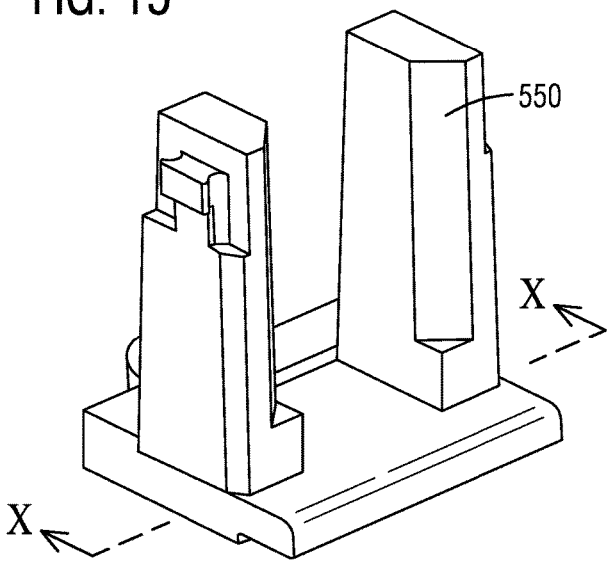
FIG. 15 illustrates an oblique view of a slot motor in accordance with an exemplary embodiment of the present invention.
Figure 16:
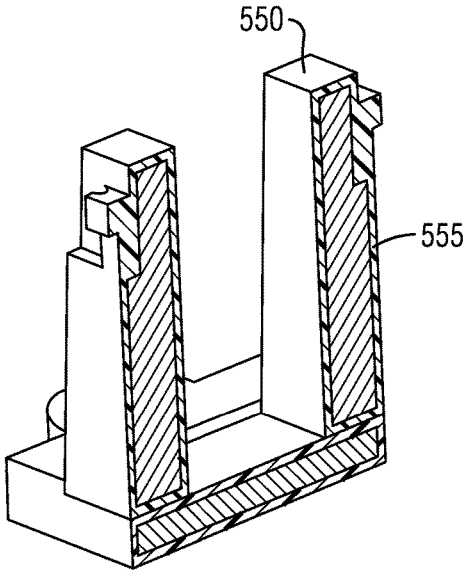
FIGS. 16 and 17 illustrate a cross-sectional view of the slot motor of FIG. 15 in accordance with an exemplary embodiment of the present invention.
Figure 17:
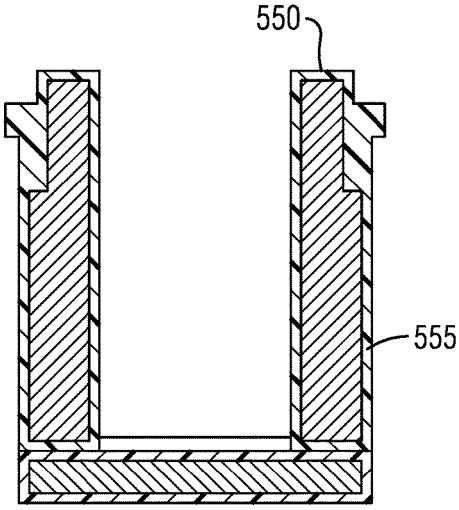

FIG. 15 illustrates an oblique view of the slot motor 550 in accordance with an exemplary embodiment of the present invention. FIGS. 16 and 17 illustrate a cross-sectional view of the slot motor 550 of FIG. 15 along an X-X axis in accordance with an exemplary embodiment of the present invention.

In one embodiment, the slot motor 550 comprises a magnetic steel structure with an insulating plastic layer 555 over-molded on it. Outgassing material may be incorporated into the over-molded plastic layer 555 of the slot motor 550, to further improve interrupting performance. The over-molded plastic layer 555 insulates the steel core of the slot motor 550 from an arc and prevents the slot motor 550 from providing an alternative electrical path which would short out the arc. In addition, as the over-molded plastic layer 555 may optionally contain out-gassing material it may assist in extinguishing the arc.

Figure 18:
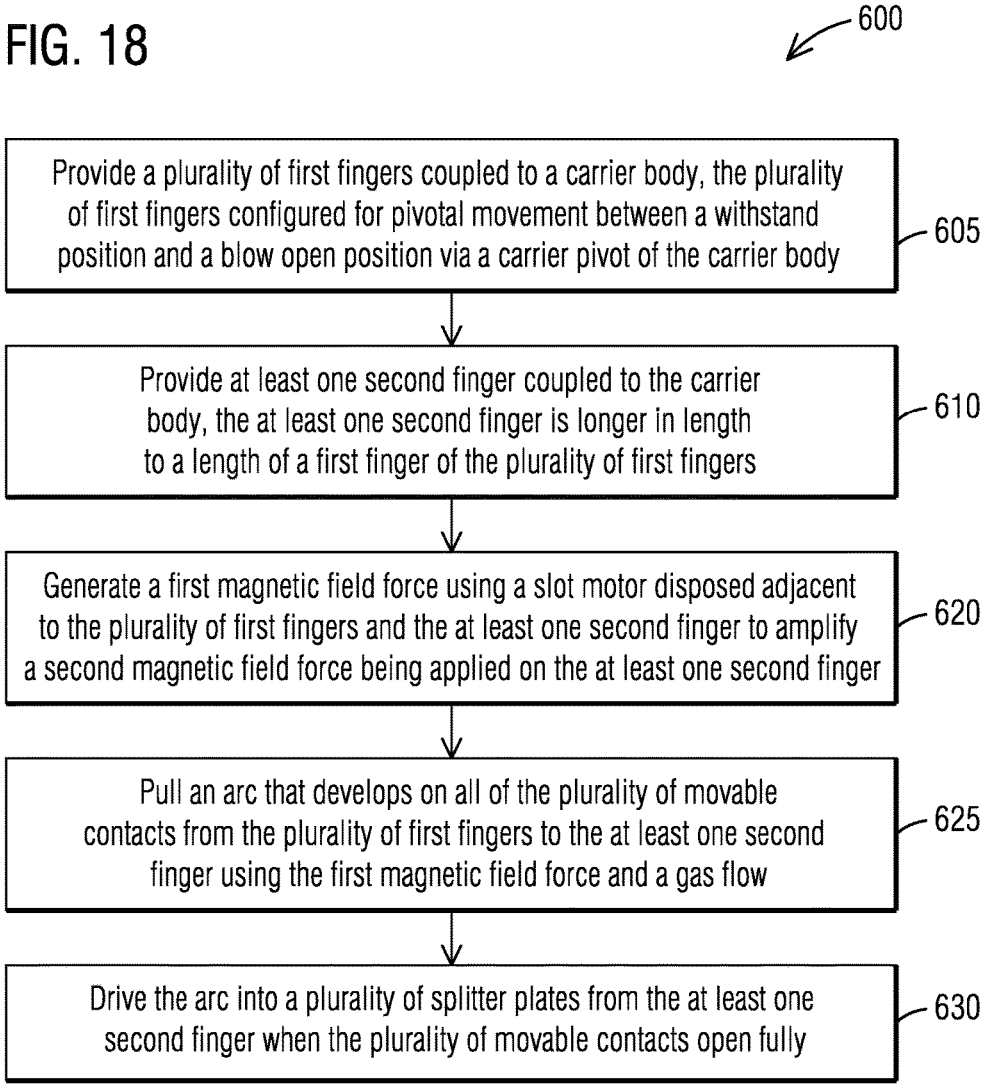
FIG. 18 illustrates a flow chart of a method of opening a plurality of movable contacts of a pole of a circuit breaker during a short circuit in accordance with an exemplary embodiment of the present invention.

As seen in FIG. 18, it illustrates a flow chart of a method 600 of opening the first plurality of movable contacts 25 of a pole of the multi-finger circuit breaker 10 of FIG. 1 during a short circuit in accordance with an exemplary embodiment of the present invention. Reference is made to the elements and features described in FIGS. 1-17. It should be appreciated that some steps are not required to be performed in any particular order, and that some steps are optional.

In step 605, the method 600 includes providing the plurality of first fingers 50 coupled to the carrier body 35. The plurality of first fingers 50 are configured for pivotal movement between a withstand position and a blow open position via a carrier pivot of the carrier body 35. The method 600 further includes, at step 610, providing at least one second finger 55 coupled to the carrier body 35. The second finger 55 is longer in length to a length of a first finger of the plurality of first fingers 50.

As shown, step 620 calls for generating a first magnetic field force using the slot motor 15 disposed adjacent to the plurality of first fingers 50 and the second finger 55 to amplify a second magnetic field force being applied on the second finger 55. Next, step 625 pertains to pulling the arc 400 that develops on all of the first plurality of movable contacts 25 from the plurality of first fingers 50 to the second finger 55 using the first magnetic field force and a gas flow. Finally, the method 600 includes, in step 630, driving the arc 400 into the plurality of splitter plates 60 from the second finger 55 when the plurality of movable contacts 25 open fully.

Embodiments of the present invention provide several advantages over the concept of multiple fingers with side extensions on the splitter plates. In a prior multi-finger system using splitter plate side extensions, however, a vertical current path between the splitter plate side legs is required to excite the magnetic field in the plates. When the contacts are closed, the vertical current path is very short, consisting only of the thicknesses of the contacts, and the thicknesses of the fixed conductor and the fingers. Likewise, when the opening angle is small, only the bottom 2 or 3 plates will generate magnetic fields. As the arc becomes longer, the longer current path provides more excitation for each plate. The splitter plates generate the strongest field when the arc is developed to the full length. But ideally, the strongest field at the very beginning of the opening process would be preferred at small angles.

By contrast, the first advantage is that in the multi-finger circuit breaker 10 as shown in FIG. 2, it is the current path in the line conductor 62 that excites a magnetic field in the slot motor 15. The length of this current path is fixed and does not depend on the opening angle of the plurality of first fingers 50 and the second finger 55. There is a strong magnetic field present even before the first plurality of movable contacts 25 begin to open.

An arc burning in splitter plates with side extensions of a prior multi-finger system using splitter plate side extensions involve an arcing current, a magnetic flux, and an arc force. The greatest arc force is generated when the arc is burning in the airspace between the two side legs. Then the arc moves deeper into the plates until it is burning from plate-to-plate. Here the magnetic force on the arc greatly reduces to near zero values, because the magnetic flux is able to complete a full circuit within the steel itself. This is acceptable because once the arc is in the splitter plates it is desirable that it should stay there until extinguished. Very little magnetic flux is crossing through the airspace between the side extensions of the plates, because it is contained within the steel. It is easy to imagine an intermediate situation as the arc is partially burning from plate-to-plate and partially burning in the airspace between the legs of the splitter plates. In this case the arc force is greatly reduced. In practice, the arc may stall in this position and never move completely into the plates. Under some conditions of low current and high voltage, there is not enough arc force to drive the arc deeper into the splitter plates, and the arc persists and continues to burn, resulting in excessive damage or failure to interrupt.

By contrast, the second advantage is that the slot motor 15 continues to generate a magnetic field in the airspace between the slot motor sides 305*a*, 305*b*, even after the arc 400 has moved deep into the plurality of splitter plates 60 and is burning from plate-to-plate. If there is any remaining arcing current burning in the airspace, it is driven toward the splitter plates 60 with a strong magnetic field. This is because the slot motor's 15 magnetic field is excited by the current flowing in the line conductor 62, not by the current flowing in the arc 400 itself.

A third advantage is that the slot motor 15 fills the available space on each side of the first plurality of fixed breaking contacts 45 and the first plurality of movable contacts 25 with solid steel, whereas with extended splitter plates, there must inherently be airspace between each plate. This means that the slot motor 15 is capable of generating a more intense magnetic field force than the splitter plates with side extensions. The above set forth advantages from the slot motor 15 provide advantages in larger or high amperage multi-finger circuit breakers.

The slot motor 15 improves the ability of a high-amperage multi-finger circuit breaker to interrupt at all its rated circuit levels, but especially with combinations of high system voltage and low available short circuit current. A circuit breaker must be able to interrupt all levels of short circuit current up to the maximum for which it is rated. Often the lower current level tests become the limiting factor for a specific voltage rating, for example 10 kA at 600V. The slot motor 15 is likely to enable large multi-finger circuit breakers to achieve higher voltage ratings, or to interrupt short circuits with reduced let-through energy, or to achieve desired short circuit ratings with a smaller extinguishing system.

Many alternative combinations with varying numbers of fingers and varying ratios of short versus long fingers may be used. Increasing the number of fingers and width of the pole would achieve higher ampere ratings by increasing the copper cross-section. Also, it may be advantageous to increase the number of fingers by reducing the thickness, without increasing the amount of copper. This is because splitting the current with additional contact interfaces would reduce contact resistance heating.

There is a trade-off between slot motor thickness and the width of the slot opening between the sides 305*a*, 305*b* of the slot motor 15. Thicker slot motor sides with a narrow opening give a much stronger magnetic field. However, this may restrict a gas flow. An optimum design point which gives the best result may be used as per a particular application or implementation.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A moving contact assembly for a multi-finger circuit breaker comprising:

a carrier body having a carrier pivot for pivotal movement between a closed position and an open position;

a first plurality of fixed breaking contacts and a first plurality of movable contacts;

a plurality of first fingers each of which is coupled to a corresponding one of the first plurality of movable contacts and coupled to the carrier body, the plurality of first fingers configured for pivotal movement between a withstand position and a blow open position via the carrier pivot of the carrier body;

at least one second finger coupled to a movable contact of the first plurality of movable contacts and coupled to the carrier body, the at least one second finger is longer in length to a length of a first finger of the plurality of first fingers;

a plurality of splitter plates disposed adjacent to the plurality of first fingers and the at least one second finger, the plurality of splitter plates are configured to influence an arc between the first plurality of fixed breaking contacts and the first plurality of movable contacts during a short circuit such that to move the arc away from between the first plurality of fixed breaking contacts and the first plurality of movable contacts and dissipate energy of the arc; and a slot motor disposed adjacent to the plurality of first fingers and the at least one second finger, the slot motor having a U-shaped portion that is configured to provide a first magnetic field force to amplify a second magnetic field force being applied on the at least one second finger and the plurality of splitter plates are configured to further amplify the second magnetic field force, wherein a set of movable contacts of the first plurality of movable contacts coupled to the plurality of first fingers are located not inside the U-shaped portion of the slot motor while the movable contact of the first plurality of movable contacts coupled to the at least one second finger is located inside the U-shaped portion of the slot motor.

2. The moving contact assembly of claim 1, wherein the slot motor comprises a magnetic steel structure over-molded with an insulating plastic.

3. The moving contact assembly of claim 1, wherein the plurality of splitter plates comprises magnetic steel.

4. The moving contact assembly of claim 1, wherein the carrier body comprises non-magnetic stainless steel.

5. The moving contact assembly of claim 1, wherein the carrier body comprises a plurality of contact pressure springs and a plurality of guide pins.

6. The moving contact assembly of claim 1, wherein the carrier body is coupled to a braid terminal of copper via a flexible braid of copper.

7. The moving contact assembly of claim 6, wherein the braid terminal is coupled to a load terminal of copper via a current transformer.

8. The moving contact assembly of claim 1, wherein the slot motor is coupled to a line conductor of copper.

9. The moving contact assembly of claim 1, wherein the carrier body comprises a finger pivot and a drive link attachment pin.

10. A pole of a multi-finger circuit breaker comprising:

a plurality of first fingers coupled to a carrier body, the plurality of first fingers configured for pivotal movement between a withstand position and a blow open position via a carrier pivot of the carrier body;

at least one second finger coupled to the carrier body, the at least one second finger is longer in length to a length of a first finger of the plurality of first fingers; and a slot motor disposed adjacent to the plurality of first fingers and the at least one second finger, the slot motor having a U-shaped portion that is configured to provide a first magnetic field force to amplify a second magnetic field force being applied on the at least one second finger, wherein a set of movable contacts of a first plurality of movable contacts coupled to the plurality of first fingers are located not inside the U-shaped portion of the slot motor while a movable contact of the first plurality of movable contacts coupled to the at least one second finger is located inside the U-shaped portion of the slot motor.

11. The pole of the multi-finger circuit breaker of claim 10, wherein the slot motor is coupled to a line conductor of copper and the slot motor comprises a magnetic steel structure over-molded with an insulating plastic, wherein the magnetic steel structure is a multi-piece structure in that two or more pieces are joined together to form a unified device.

12. The pole of the multi-finger circuit breaker of claim 10, wherein the line conductor includes a plurality of fixed contacts that correspond to a plurality of respective ones of movable contacts attached to the plurality of first fingers and the at least one second finger.

13. The pole of the multi-finger circuit breaker of claim 10, wherein the carrier body comprises non-magnetic stainless steel, a plurality of contact pressure springs and a plurality of guide pins, wherein the carrier body is coupled to a braid terminal of copper via a flexible braid of copper.

14. The pole of the multi-finger circuit breaker of claim 13, wherein the braid terminal is coupled to a load terminal of copper via a current transformer.

15. The pole of the multi-finger circuit breaker of claim 13, wherein the carrier body comprises a finger pivot and a drive link attachment pin.

16. The pole of the multi-finger circuit breaker of claim 10, wherein the at least one second finger extends into the slot motor.

17. A method of opening a plurality of movable contacts of a pole of a circuit breaker during a short circuit, the method comprising:

providing a plurality of first fingers coupled to a carrier body, the plurality of first fingers configured for pivotal movement between a withstand position and a blow open position via a carrier pivot of the carrier body;

providing at least one second finger coupled to the carrier body, the at least one second finger is longer in length to a length of a first finger of the plurality of first fingers; and generating a first magnetic field force using a slot motor disposed adjacent to the plurality of first fingers and the at least one second finger to amplify a second magnetic field force being applied on the at least one second finger, wherein a set of movable contacts of a first plurality of movable contacts coupled to the plurality of first fingers are located not inside a U-shaped portion of the slot motor while a movable contact of the first plurality of movable contacts coupled to the at least one second finger is located inside the U-shaped portion of the slot motor.

18. The method of claim 17, further comprising:

pulling an arc that develops on all of the plurality of movable contacts from the plurality of first fingers to the at least one second finger using the first magnetic field force and a gas flow.

19. The method of claim 18, further comprising:

driving the arc into a plurality of splitter plates from the at least one second finger when the plurality of movable contacts open fully.

* * * * *